US005873459A

United States Patent [19]

Yeo

[11] Patent Number: 5,873,459

[45] Date of Patent: Feb. 23, 1999

[54] PACKING APPARATUS FOR CONTENTS OF MICROWAVE

[75] Inventor: Tae Hong Yeo, Kyungsangnam-do, Rep. of Korea

[73] Assignee: LG Electronics Inc., Seoul, Rep. of Korea

[21] Appl. No.: 542,059

[22] Filed: Oct. 12, 1995

[30] Foreign Application Priority Data

Oct. 21, 1994 [KR] Rep. of Korea ..... 1994/26988

[51] Int. Cl.[6] ..... B65D 85/00; B65D 85/30

[52] U.S. Cl. ..... 206/320; 206/454; 206/521; 206/583

[58] Field of Search ..... 206/320, 450, 206/451, 454, 583, 586, 592, 521

[56] References Cited

U.S. PATENT DOCUMENTS

| | | | |
|---|---|---|---|
| 2,005,967 | 6/1935 | Berdan | 206/454 |
| 2,177,241 | 10/1939 | Burack | 206/454 |
| 2,746,667 | 5/1956 | Murphy | 206/521 X |
| 2,865,499 | 12/1958 | Brogren | 206/583 X |
| 4,429,791 | 2/1984 | Ruppel et al. | 206/454 |
| 4,865,200 | 9/1989 | Sullivan et al. | 206/583 |

*Primary Examiner*—Bryon P. Gehman
*Attorney, Agent, or Firm*—Fish & Richardson PC

[57] ABSTRACT

A packing apparatus for fixing the contents of a microwave by using a corrugated paper instead of styrofoam, including a base surface contacting one side of a glass tray of a plane form, a hole formed on each of upper and lower sides of the base surface for holding the glass tray being inserted therein, wings being extended from the upper and lower sides of the base surface and folded onto a rotate ring which is laid and held on the glass tray, and first and second supporters being extended from left and right sides of the base surface for diagonally positioning into a microwave base surface and the wings which hold firmly the glass tray and the rotate ring within the cavity of a microwave, thereby fixing the contents well, preventing environmental pollution and reducing the manufacturing cost of the product.

4 Claims, 5 Drawing Sheets

PACKING APPARATUS FOR CONTENTS OF MICROWAVE

BACKGROUND OF THE INVENTION

The present invention relates to a packing apparatus for the contents of a microwave, and more particularly to an apparatus for fixing the contents of a microwave in place in the microwave cavity by using a corrugated paper instead of styrofoam.

A conventional packing apparatus for the contents of a microwave has a structure as shown in FIG. 1. Each of the grooves 4 and 2 for seating a glass tray 3 and rotate ring 1 is formed in a styrofoam packing 5 being disposed at the lowermost portion of the apparatus. A corrugated paper packing 6 at the uppermost portion is for preventing movements of glass tray 3 and rotate ring 1 within the microwave cavity.

A method of packing glass tray 3 and rotate ring 1 into a microwave by using the conventional packing apparatus having such a structure, is described as follows. Rotate ring 1 and glass tray 3 are seated into grooves 2 and 4, respectively, and styrofoam packing 5 is put into a cavity of the microwave. Then, corrugated paper packing 6 is inserted in the remaining space of the cavity being occupied by styrofoam packing 5 to prevent the contents from being moved.

However, the conventional technology has the following problems.

First, using styrofoam which does not decay causes difficulty with the disposal of the waste packing product and contamination of environment.

Second and the last, high price of the styrofoam raises the manufacturing cost of a product.

SUMMARY OF THE INVENTION

To solve the above problems, it is an object of the present invention to provide an apparatus for efficiently packing the contents of a microwave by utilizing a corrugated paper.

Accordingly, to achieve the above object, there is provided an apparatus for packing the contents of a microwave including: means for fixing the contents by plane-contacting the both sides of the contents of a plane type and line-contacting the both edges of the contents; and means for preventing movement of the fixing means by diagonally disposing the fixing means in the microwave, wherein the fixing means including a base surface plane-contacting one side of the contents; a hole being formed on each of the upper and lower sides of the base surface for holding the edge of the contents; and wings being extended from the upper and lower sides of the base surface and being folded onto the other side of the contents and, wherein the movement prevention means is supporters having different length from each other and being formed on the left and right sides of the fixing means.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
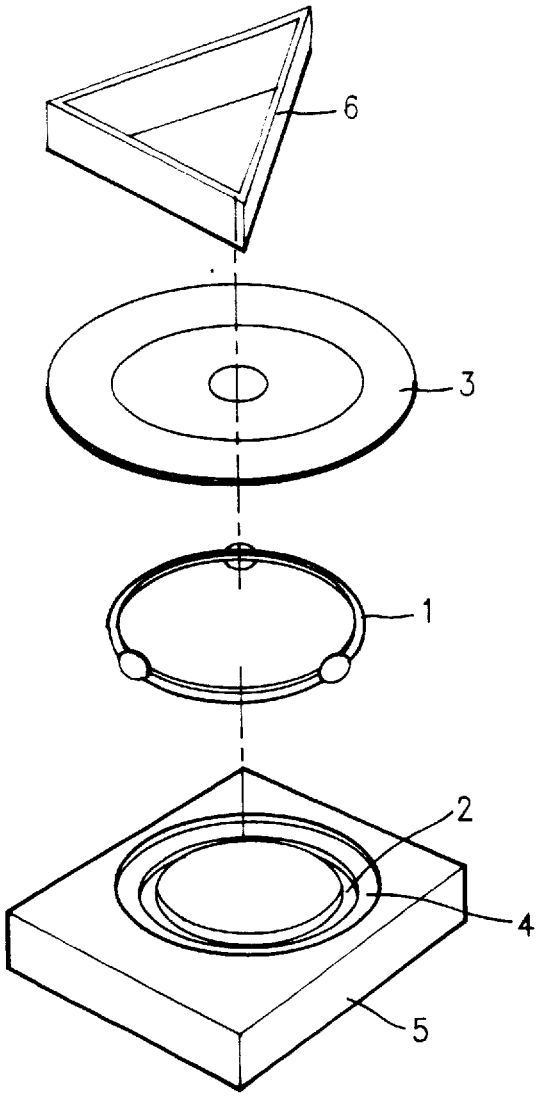
FIG. 1 is a perspective view illustrating a conventional disassembled packing apparatus of the contents of a microwave.
Figure 2A:
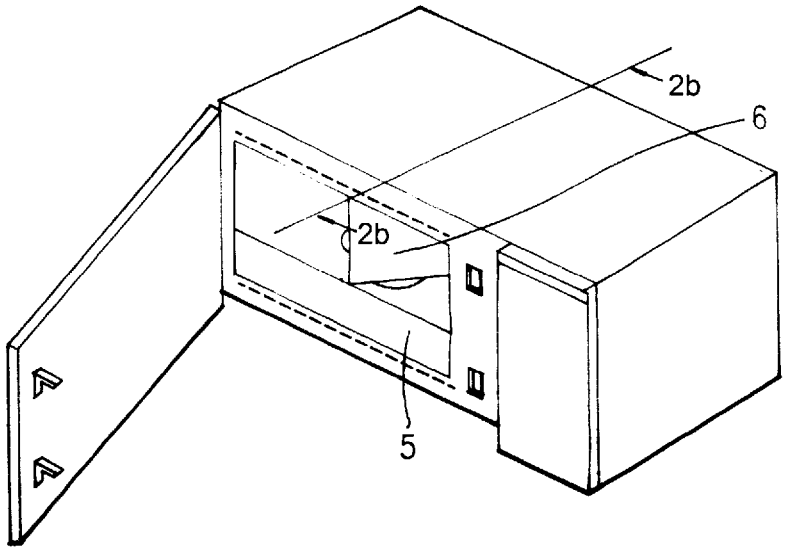
FIG. 2A is a view showing the conventional apparatus of FIG. 1 which is installed in the microwave.
Figure 2B:
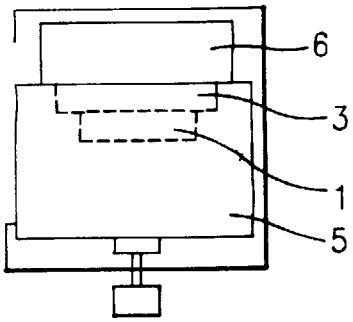
FIG. 2B is a section taken along the line A—A illustrating the apparatus installed in the microwave of FIG. 2A.
Figure 3A:
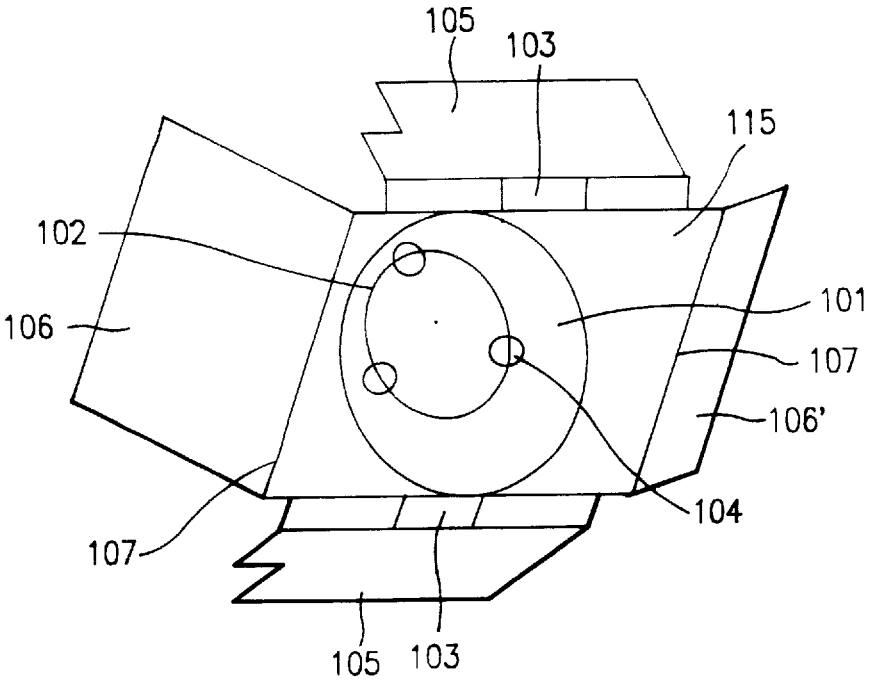
FIG. 3A is a perspective view illustrating an apparatus for packing the contents of the microwave according to the present invention.
Figure 3B:
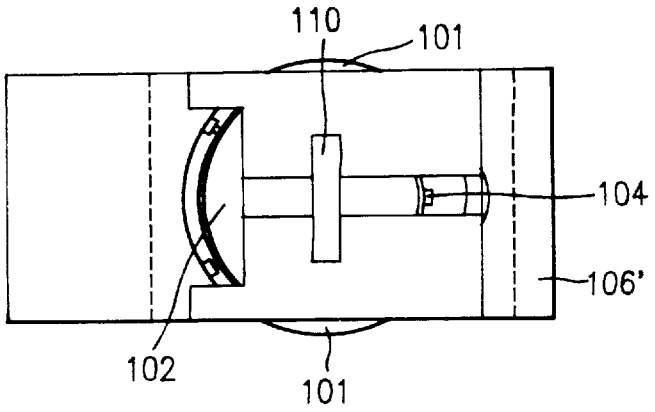
FIG. 3B is a view showing an assembled status of the packing apparatus of FIG. 3A.
Figure 4A:
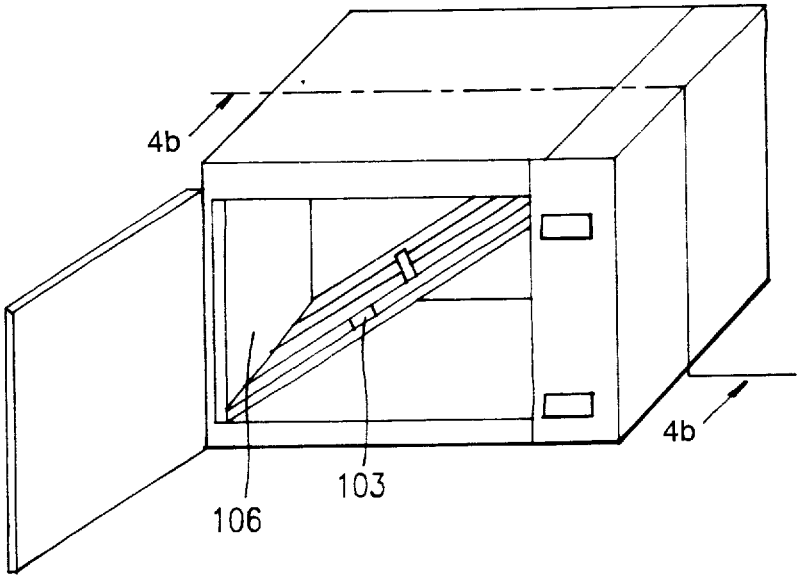
FIG. 4A is a perspective view illustrating an embodiment of the packing apparatus of the present invention.
Figure 4B:
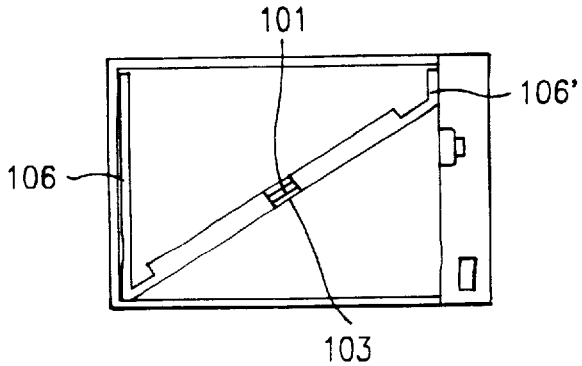
FIG. 4B is a section taken along the line B—B showing an embodiment of the packing apparatus of the present invention.
Figure 5:
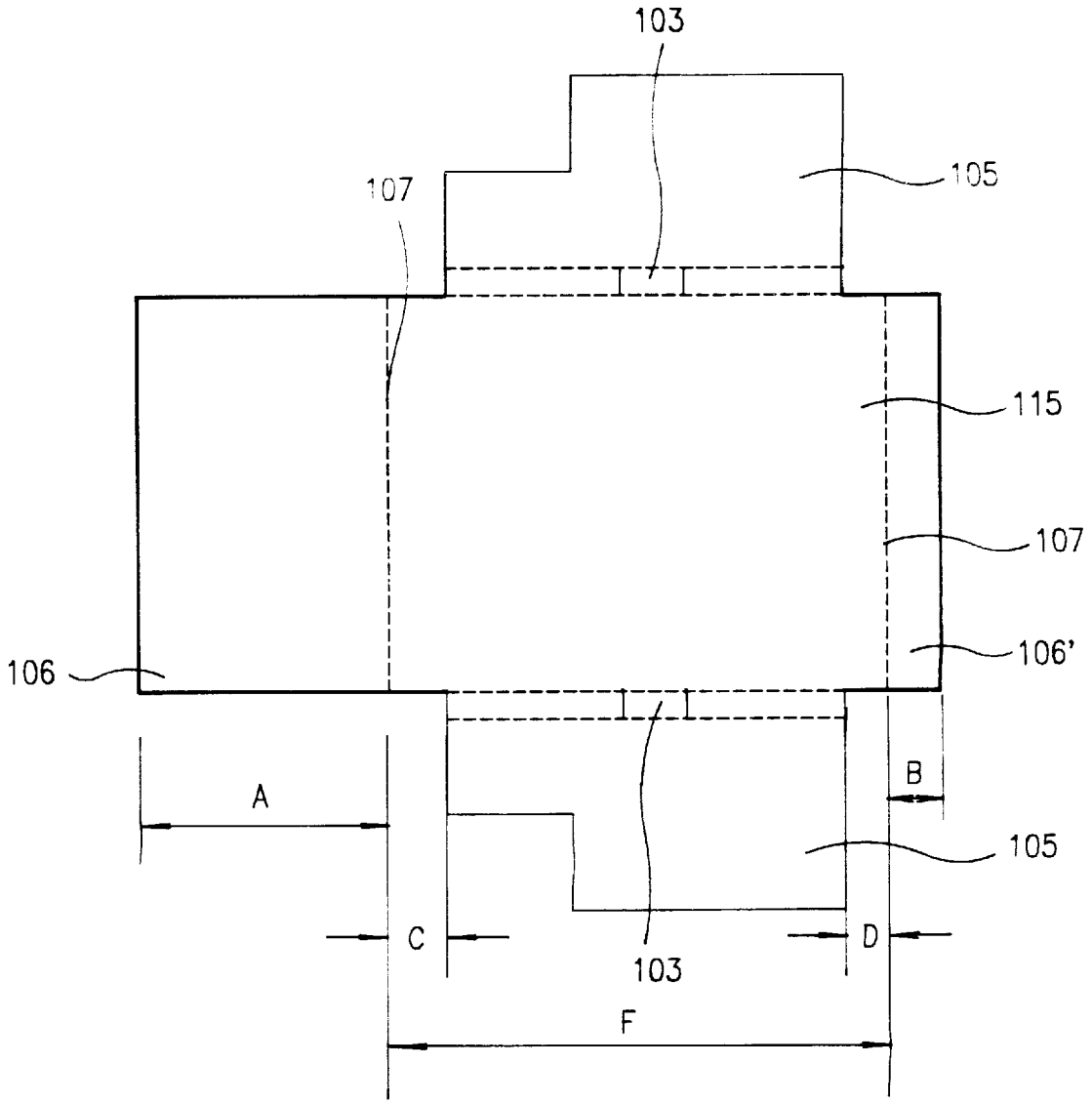
FIG. 5 is a development figure of the embodiment of the present invention shown in FIG. 3.

Referring to FIGS. 3 to 5, an embodiment of the present invention will be described now.

In FIG. 3, the embodiment of the present invention comprises a base surface 115 contacting one side of glass tray 101 of a plane form, holes 103 formed on each of upper and lower sides of the base surface for holding glass tray 101 being inserted therein, wings 105 being extended from the upper and lower sides of base surface 115 and folded onto rotate ring 102 which is laid and held on glass tray 101, and first and second supporters 106 and 106' being extended from left and right sides of the base surface for diagonally positioning into a microwave base surface 115 and wings 105 which hold firmly glass tray 101 and rotate ring 102.

The length of supporters 106 and 106' is formed to be different from each other. Base surface 115 is made of a corrugated paper. Each part of wings 105 is not folded onto each other so as to leave rollers 104 of rotate ring 102 exposed and fixed using an adhesive tape 110.

In FIG. 5, a development figure, the length "A" of first supporter 106 is the same as the height of the microwave cavity, and the length "F" of base surface 115 is a bit less than the diagonal length of the cavity. Therefore, a corrugated-paper assembly can be easily put into and taken out from the cavity of the microwave.

The method of packing the glass tray and rotate ring in the microwave using the contents packing apparatus of the present invention is as follows.

After glass tray 101 is placed on the center of holes 103, rotate ring 102 is put on glass tray 101. Then, holding glass tray 101 and rotate ring 102, wings 105 are folded and fixed by an adhesive tape. After wings 105 are fixed by the adhesive tape, each of supporters 106 and 106' is folded and the assembly is diagonally inserted into the cavity. When supporters 106 and 106' are closely inserted into an inner wall of the microwave, installation is completed as shown in FIGS. 4A and 4B.

As described above, the packing apparatus of the contents of the microwave according to the present invention has merits as follows.

First, since hole 103 holds the edge of glass tray 101 and base surface 115 and wings 105 shield glass tray 101 and rotate ring 102, the contents can be well fixed.

Second, supporters 106 and 106' prevent base surface 115 and wings 105 from being moved due to impact or a shock.

Third, environmental pollution can be prevented by using a corrugated paper instead of styrofoam which is pollutant.

Fourth and the last, the manufacturing cost of the product can be reduced by using a cheap corrugated paper instead of high-priced styrofoam.

What is claimed is:

1. An apparatus for packing contents of a microwave, the apparatus comprising:

means for fixing the contents of the microwave, the means including:

a base surface configured to contact one side of the contents;

a hole being formed at each of opposite ends of said base surface and configured to hold an edge of the contents; and wings extending from the opposite ends of said base surface and being configured to be folded over a side of the contents opposite the side to be contacted by the planar base surface, and means for preventing movement of said fixing means by diagonally disposing said fixing means in the microwave.

2. An apparatus for packing the contents of a microwave according to claim 1, wherein said movement prevention means comprises supporters having different lengths and extending from ends of said base surface from which said wings do not extend.

3. An apparatus for packing the contents of a microwave according to claim 2, wherein said fixing means is made of a corrugated paper.

4. An apparatus for packing the contents of a microwave according to claim 1, wherein said wings are configured so that protruding portions of the contents are left exposed when the wings are folded over the contents.

* * * * *